US011802018B2

(12) United States Patent
Verhoeven et al.

(10) Patent No.: US 11,802,018 B2
(45) Date of Patent: Oct. 31, 2023

(54) SHEET STACKER COMPRISING A SHEET FLIPPING DEVICE AND A HOLDING DEVICE

(71) Applicant: Canon Production Printing Holding B.V., Venlo (NL)

(72) Inventors: Erik P. J. Verhoeven, Venlo (NL); Johannes E. P. Peulen, Venlo (NL)

(73) Assignee: Canon Production Printing Holding B.V., Venlo (NL)

( * ) Notice: Subject to any disclaimer, the term of this patent is extended or adjusted under 35 U.S.C. 154(b) by 150 days.

(21) Appl. No.: 17/533,258

(22) Filed: Nov. 23, 2021

(65) Prior Publication Data

US 2022/0169469 A1 Jun. 2, 2022

(30) Foreign Application Priority Data

Nov. 27, 2020 (EP) ..... 20210386

(51) Int. Cl.
*B65H 29/22* (2006.01)
*B65H 29/40* (2006.01)
*B65H 29/24* (2006.01)

(52) U.S. Cl.
CPC ..... *B65H 29/22* (2013.01); *B65H 29/242* (2013.01); *B65H 29/40* (2013.01); *B65H 2301/4212* (2013.01); *B65H 2404/651* (2013.01); *B65H 2404/6551* (2013.01); *B65H 2406/323* (2013.01)

(58) Field of Classification Search
CPC ..... B65H 29/242; B65H 29/40; B65H 29/60; B65H 2406/323
USPC ..... 271/302, 187, 315
See application file for complete search history.

(56) References Cited

U.S. PATENT DOCUMENTS 4,575,069 A * 3/1986 Burkhart ..... B65H 31/02 271/186
5,026,036 A * 6/1991 Takahashi ..... B65H 29/40 271/291
5,065,996 A * 11/1991 McGraw ..... B65H 29/40 271/187
5,145,167 A * 9/1992 McGraw ..... B65H 29/40 271/306
5,172,904 A * 12/1992 Sze ..... B65H 29/40 271/187
5,261,655 A * 11/1993 Keller ..... B65H 29/70 271/187

(Continued)

FOREIGN PATENT DOCUMENTS

EP 0745546 A2 12/1996
EP 2776352 B1 8/2015
EP 3148908 B1 4/2018

OTHER PUBLICATIONS

Search Report issued in European priority application 20210386.7, dated May 11, 2021.

*Primary Examiner* — Patrick Cicchino
(74) *Attorney, Agent, or Firm* — Birch, Stewart, Kolasch & Birch, LLP

(57) ABSTRACT

During flipping sheets may fold upon themselves under the influence of gravity. To prevent a sheet stacker is provided with a holding device for releasably holding at least a portion of the sheet at least partially during the flipping of the sheet by a sheet flipping device, wherein the holding device is configured for movement of the held portion of the sheet in a first direction perpendicular to the flipping axis.

17 Claims, 4 Drawing Sheets

(56) References Cited

U.S. PATENT DOCUMENTS

| | | | | |
|---|---|---|---|---|
| 5,476,256 | A * | 12/1995 | Fortuna | B65H 29/40 101/415.1 |
| 8,235,382 | B2 * | 8/2012 | Taniguchi | B65H 29/40 271/187 |
| 2010/0109228 | A1 * | 5/2010 | Obara | B65H 29/242 271/4.08 |
| 2011/0309566 | A1 | 12/2011 | Taniguchi et al. | |

* cited by examiner

SHEET STACKER COMPRISING A SHEET FLIPPING DEVICE AND A HOLDING DEVICE

BACKGROUND OF THE INVENTION

1. Field of the invention

The invention relates to a sheet stacker, a printer comprising such a sheet stacker, and a method for stacking sheets.

2. Description of Background Art

Sheet stackers, specifically those used for medium-to-large volume printers, may comprise a sheet flipping device, which reverses the orientation of the sheet during the stacking process. Such sheets stackers are known e.g. from EP 2776352 A1. It is further known that when flipping more rigid sheets, a transport belt may be positioned adjacent the flipping device to force the rigid sheets into the desired flipping motion, for example from US2011309566 AA, U.S. Pat. No. 5,261,655 A, U.S. Pat. No. 5,026,036 A, or U.S. Pat. No. 5,145,167 A. It was found that such configurations were not able to more reliably and stack relatively very flexible sheets, such as (long) paper sheets with low grammage or thin foils. It was found that sheets could collapse upon themselves during flipping, resulting in an undesired fold in the sheet and a disturbed sheet stack. It is further known to support the sheets during flipping by means of an air vortex, as described in e.g. EP 3148908 A1.

SUMMARY OF THE INVENTION

It is an object of the invention to provide more reliable sheet stacking, specifically one that supports a wider media range including longer and/or more flexible sheets.

In accordance with the present invention, a sheet stacker according to claim 1, a printer according to claim 14, and a method according to claim 15 are provided. The sheet stacker according to the present invention comprises:

- A sheet flipping device for flipping a received sheet around a flipping axis with respect to an orientation wherein the sheet was received;
- A holding device for releasably holding at least a portion of the sheet at least partially during the flipping of the sheet by the sheet flipping device, wherein the holding devices is configured for movement of the held portion of the sheet in a first direction perpendicular to the flipping axis;
- a sheet supply path for supplying sheet to the sheet flipping device, wherein sheet supply path and the holding device are moveable with respect to one another between a first position wherein a portion of the sheet may pass into the sheet flipping device without being adhered against the holding device and a second position wherein the holding device is able to draw a portion of the sheet against it.

As the sheet is engaged by the sheet flipping device the holding device holds a portion of the sheet engaged by flipping device, preventing the sheet from collapsing upon itself under the influence of gravity. The holding device is configured to move the held portion of the sheet to allow the sheet sufficient freedom of movement to execute its flipping motion. Thereby sheets regardless of their flexibility are reliably flipped and stacked. The object of the present invention has been achieved.

More specific optional features of the invention are indicated in the dependent claims.

In an embodiment, the holding device is arranged for engaging an outer surface of the sheet. The outer surface herein is the radially outward facing side of the sheet during its flipping motion. This is preferably the bottom side of the sheet after it has been flipped.

In an embodiment, the sheet supply path is moveable with respect to both the holding device and the sheet flipping device. The sheet supply path has a sheet releasing end or exit, where a sheets leave the sheet supply path, for example as defined by a pinch or and end of a conveyor belt. The exit is moveable by means of an actuator, such that the exit can be positioned either adjacent the sheet flipping device in the first position or adjacent the holding device in the second position. In another embodiment, the holding device is moveable with respect to the sheet flipping device and the sheet supply path. In the first position, the holding device is moved out of the a trajectory of a sheet from the sheet supply path into the sheet flipping device, while in the second position the holding device is positioned along, in, or at said trajectory sufficiently close to the sheet to adhere a trailing portion to the holding device.

In an embodiment, the sheet flipping device comprises a flipping wheel provided with at least one slot for receiving the sheet. The flipping wheel is rotatable, such that the sheet with its leading edge engaged in the slot is flipped around the rotation axis of the flipping wheel. The flipping wheel may be provided with one or more slots, which may be positioned in a receiving position in time with the arrival of a sheet. This results in a highly productive system. It will be appreciated that such a flipping wheel is described in detail in EP 2776352 A1, the description of which is herein incorporated by reference.

In an embodiment, the holding device comprises a holding surface to which the portion of the sheet is adhered during flipping, the holding surface being moveable in the first direction. The holding surface is able to carry the engaged portion of the sheet in the first direction to complete the flipping motion of the sheet by the sheet flipping device. The holding surface moves the held portion of the sheet away from the flipping wheel, such that the trailing portion of the sheet unrolls in said direction, until the trailing portion is released.

In an embodiment, the holding device comprises an endless conveyor belt. The conveyor belt comprises means for holding the portion of the sheet against it, such as suction holes for applying an underpressure or an electrostatically charged surface. The endless belt loops cyclically around its support making it well suited for processing large volumes of consecutive sheets.

In an embodiment, the conveyor belt is provided with suction holes for applying an underpressure to the portion of the sheet, such that the portion is held against the belt. The underpressure may be applied via a suction box positioned adjacent the belt with openings facing the flipping volume through which the sheets travels during its flipping motion. The suction box is provided with or connected to a suction source, such as a pump or fan.

In an embodiment, the flipping device defines a flipping volume through which the sheet travels during flipping, and wherein conveyor belt is positioned over the flipping device and over the flipping volume. The holding device is positionable sufficiently adjacent the sheet flipping device, such that it is able to draw against it a sheet which is engaged by the sheet flipping device. To support the portion of the sheet during its flipping motion, the holding device extends over the flipping volume, preferably over the majority of or the entire flipping volume.

In an embodiment, the holding device is positioned over the sheet flipping device and extends away from the sheet flipping device in a direction parallel to a sheet stacking surface for receiving the flipped sheets. The sheet flipping device is configured to form a sheet stack on the sheet stacking surface. The flipping volume is contained between the holding device and the sheet stacking surface. The sheet stacking surface may be height adjustable to compensate for a growing sheet stack. The sheet stacking surface preferably extends in the first direction. The holding surface is preferably configured to move in said first direction. In a further embodiment, the holding device and the flipping device, specifically the flipping axis, are moveable with respect to one another. The height of the flipping volume may be determined by setting a predetermined distance between the sheet stacking surface and the flipping axis. The holding device or the flipping device may be made to be height adjustable. The sheet stacking surface is preferably height adjustable to maintain the top level of the sheet stack constant with regard to the flipping axis.

In an embodiment, the sheet stacker further comprises a controller configured to control the sheet stacker, such that:

- in a first state a leading portion of the sheet is received by the sheet flipping device and partially transported by the sheet flipping device without the leading portion being drawn against the holding device;
- in a second state a trailing portion of the sheet is drawn against the holding device during the flipping motion of the sheet.

In the first state the leading portion, specifically the leading edge of the sheet, passes into the slot of the sheet flipping device without interference by the holding device. The holding device may be positionable out of the path of the incoming sheet, at least with respect to the sheet flipping device. The holding forces exerted by the holding device thus do not affect the sheet's entry into the slot of the flipping wheel. In a second state the holding device is positionable or positioned with respect to the flipping wheel, such that the sheet is affected by the holding forces exerted by the holding device. In consequence, a portion of the sheet following the leading portion is drawn against the holding device and held there. The held portion is moved in the first direction as the sheet is flipped, preferably by moving the holding surface engaging the sheet in the first direction.

In an embodiment, the sheet stacker further comprises a sheet supply path for supplying sheet to the sheet flipping device, wherein the holding device is positioned adjacent the sheet supply path. In another embodiment, the sheet supply path is moveable with respect to the holding device between a first position wherein a portion of the sheet may pass into the sheet flipping device without being adhered against the holding device and a second position wherein the holding device is able to draw a portion of the sheet against it. An actuator may be provided for moving the sheet supply path and the holding device with respect to another. In the first corresponding to the first state the exit of the sheet supply path is preferably near the flipping wheel and remote from the holding device, while in the second position corresponding to the second state the exit is positioned sufficiently near the holding device to allow the holding device to draw the sheet against it. In the second state the exit may be at a greater distance from the flipping wheel as in the first state. This prevents the holding device from affecting delivery of the sheets from the sheet supply path into the slots of the flipping wheel.

In an embodiment, the flipping wheel has a receiving position for receiving a sheet from a sheet supply path and a trigger position different from the receiving position, wherein the controller is configured to switch the sheet stacker from the first to the second state, when the flipping wheel reaches the trigger position. The trigger position may be determined by a suitable sensor, such as an encoder for determining the orientation of the flipping wheel or an optical or touch sensor, which sensor detects the sheet reaching a certain position, such as the leading edge of the sheet contacting a stop element which ejects the sheet from its slot. When the controller determines that the sheet has reached the trigger position, the sheet supply path and the holding device are brought into proximity with each other, such that a portion of the sheet is drawn against the holding device. Before the arrival of a subsequent sheet, the controller returns the sheet stacker to the first state, preferably by controlling the actuator to increase the distance between the holding device and the sheet supply path.

In an embodiment, the holding device extends between a sheet supply path and a bypass path such that a sheet may be transported by the holding device from the sheet supply path to the bypass path without engagement with the sheet flipping device. The sheet flipping device may be bypassed by allowing the entire sheet to be engaged by the holding device. The leading portion of the sheet is for example transported from the sheet supply path onto the holding device with the sheet stacker in the second state at the arrival of said sheet. The leading edge and with it the rest of the sheet travels along the holding the device towards the bypass path, where it is released from the holding device. This allows the sheet stacker to direct specific sheets to an output location different than the sheet flipping device, for example a finisher configured for stapling, coating, book binding, etc. This further allows the sheet stacker to handle large sheets with dimensions exceeding its stacking capacity.

The present invention further relates to a printer comprising a sheet stacker according to the present invention. The printer is preferably a sheet printer, very preferably an inkjet sheet printer.

The present invention further relates to a method for stacking sheets comprising the step of a sheet flipping device flipping a sheet, the step of a holding device engaging a portion of the sheet and said holding device transporting the held portion away from a flipping axis of the sheet flipping device, and the step of the holding device releasing the portion of the sheet during the final part of the flipping motion of the sheet. A sheet supply path is moved with respect to the holding device for supplying sheet to the sheet flipping device between a first position wherein a portion of the sheet may pass into the sheet flipping device without being adhered against the holding device and a second position wherein the holding device is able to draw a portion of the sheet against it. Preferably, the sheet supply path is moved with respect to the holding device into the first position, followed by, while in the first position, passing a portion of the sheet may from the sheet supply path into the sheet flipping device without being adhered against the holding device. In another embodiment, the method further comprises the steps of moving the sheet supply path with respect to the holding device into the second position, and, while in the second position, the holding device drawing a portion of the sheet against it.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
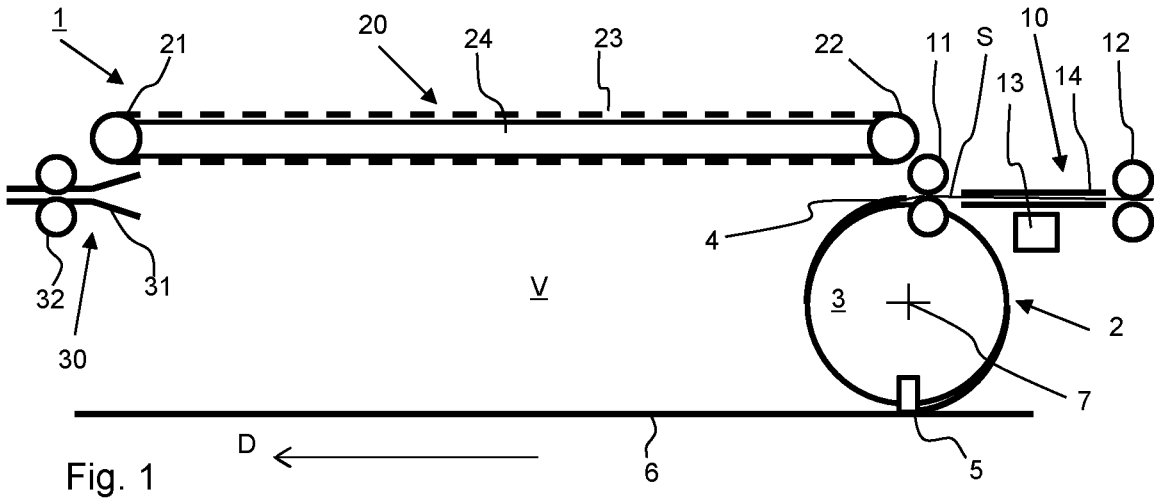
FIG. 1 is a schematic cross-sectional side view of the sheet stacker according to the present invention in the first state when receiving a sheet.

The present invention will now be described with reference to the accompanying drawings, wherein the same reference numerals have been used to identify the same or similar elements throughout the several views.

Figure 7:
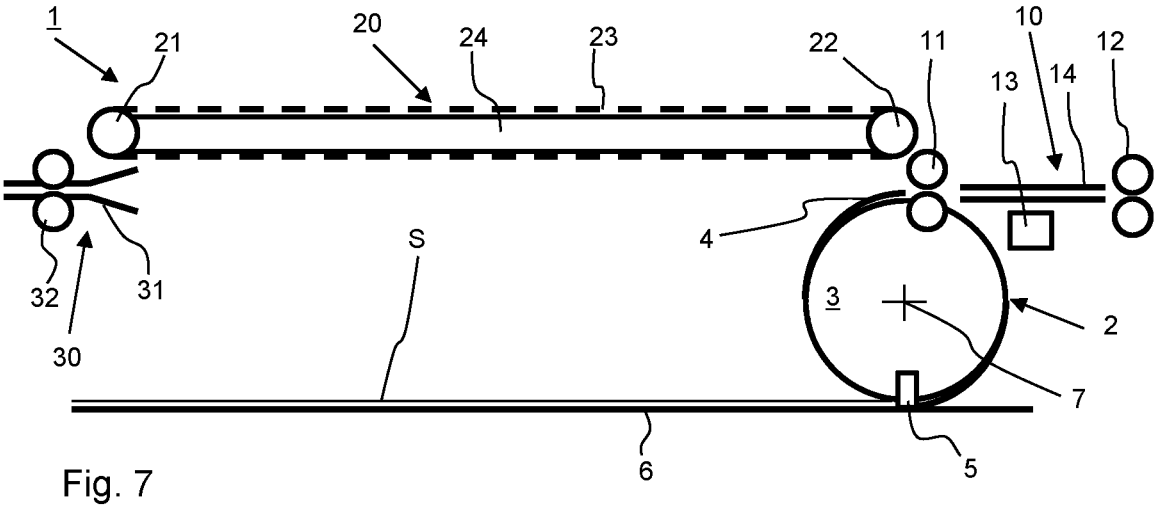
FIG. 7 is a schematic cross-sectional side view of the sheet stacker of FIG. 1 wherein the flipped sheet is positioned on the sheet stacking surface.
Figure 8:
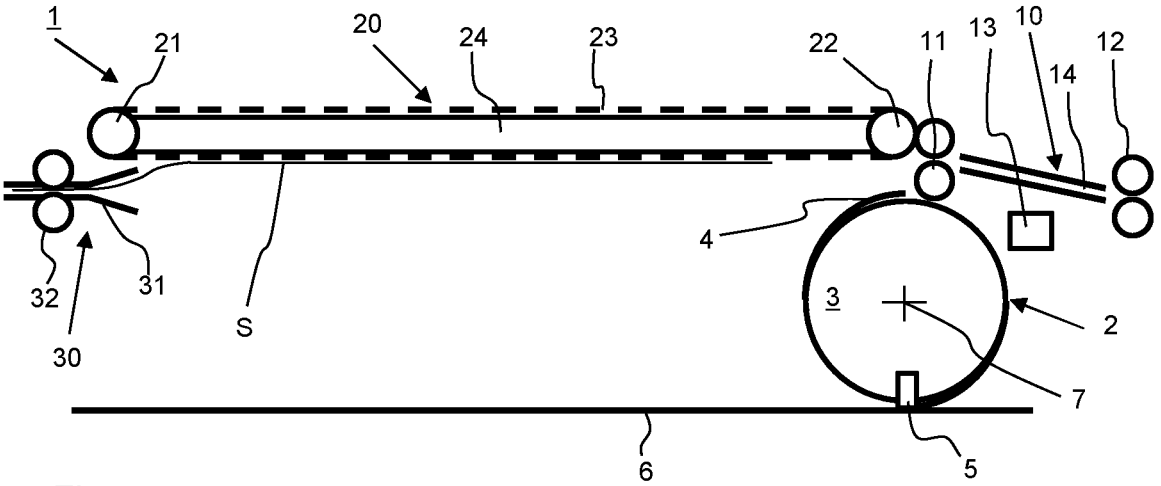
FIG. 8 is a schematic cross-sectional side view of the sheet stacker of FIG. 1 wherein the sheet bypasses the sheet flipping device via the holding device.

FIG. 1 illustrates an embodiment of the sheet stacker 1 according to the present invention in the first state wherein the flipping wheel 3 of the flipping device 2 receives a sheet S from the sheet supply path 10 into one of its receiving slots 4. The flipping device 2 is configured to rotate around its flipping axis 7, such that a sheet S held in the slot 4 is flipped through partially flipped through the flipping volume V. The leading edge of the sheet S is stopped at the stop element 5, which ejects the sheet S from the slot 4. The stop element 5 is provided at a position along the circumference of the flipping wheel 3. The flipping motion will be completed by further feeding the trailing portion of the sheet S into the flipping volume V. The flipped sheet S is stacked onto the sheet stacking surface 6 upon which the flipped sheets S may be stacked on top of one another. The holding device 20 is positioned over the flipping volume V and is configured to releasably hold and transport at least a portion of the sheet S in a first direction D parallel to the sheet stacking surface 6. The portion of the sheet S may be released during its flipping process (illustrated in FIGS. 1 to 7) or the entire sheet S may be transported towards the bypass path 30 to bring the sheet S to a further sheet processing device, such as a finisher for cutting, stapling, laminating, book binding, etc. (as illustrated in FIG. 8). The holding device 20 may also make a sheet S bypass sheet the flipping device 2 in this manner and subsequently position the sheet S above the sheet stacking surface 6. The holding device 20 may then release the sheet S, such that it is positioned on the sheet stacking surface 6 or on a sheet stack already present. This allows the sheet stacker 1 to stack sheets S without flipping. This is advantageous for sheets which are, for example, too rigid or too large for flipping by the flipping device 2.

In FIG. 1 the flipping wheel 3 is positioned in the receiving position. FIG. 1 further illustrates the step of the sheet S being received by the sheet flipping device 2. The slot 4 is positioned in alignment with the sheet supply path, such that a sheet S may be fed from the sheet supply path 10 into the slot 4. The sheet supply path 10 is positioned in its first position, such that it extends towards the slot 4 to supply a sheet S into the slot 4, when the sheet flipping device is oriented in the receiving position. The holding device 20 is positioned sufficiently remote from the sheet supply path 10, such that the holding forces do not affect the trajectory of the incoming sheet S towards the slot 4.

The sheet supply path 10 comprises one or more transport devices, such as motorized transport pinches 11, 12 to drive the sheet S into the slot 4. The sheet supply path 10 preferably extends upstream towards a printer. Sheet guides 14 formed as plates or fingers 14 may be provided along the sheet supply path 10 to guide the sheet S. When receiving the sheet S, the flipping wheel 3 may be stationary in the receiving position or be in rotational movement out of the initial receiving position. In the latter case the circumferential speed of the slot 4 is relatively lower that the transport speed of the sheet S on the sheet supply path 10, such that the sheet S is inserted into the slot 4. The controller (not shown) may be configured to drive the transport pinch 11 with a greater speed as compared to the circumferential speed that the controller sets for the flipping wheel 3.

Figure 2:
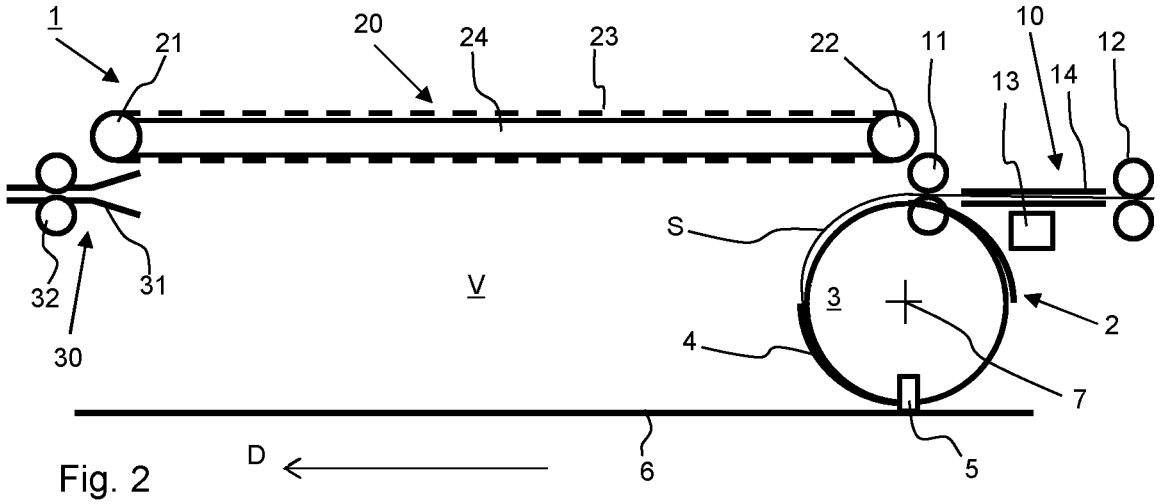
FIG. 2 is a schematic cross-sectional side view of the sheet stacker of FIG. 1 with the leading edge of the sheet at its release position.

FIG. 2 shows a step of the flipping wheel 3 with the received sheet S rotating to the eject position wherein the leading edge of the sheet S in the slot 4 contacts the stop element 5. The flipping wheel 3 is positioned at a different position from the stop element 5 along the direction of the flipping axis 7. Preferably, multiple similar flipping wheels 3 are positioned in between multiple stop elements 5, such that the sheet S is stopped at several positions along its leading edge. The downstream portion of the sheet S is still in engaged by one or more the transport devices 11, 12 of the sheet supply path 10. Preferably, the rotational velocity of the slots 4 corresponds or matches the velocity of the one or more transport devices 11, 12 holding the downstream portion of the sheet S, though the transport devices 11, 12 may also be driven at a greater velocity to make the sheet S fold away from the flipping wheel 3.

Figure 3:
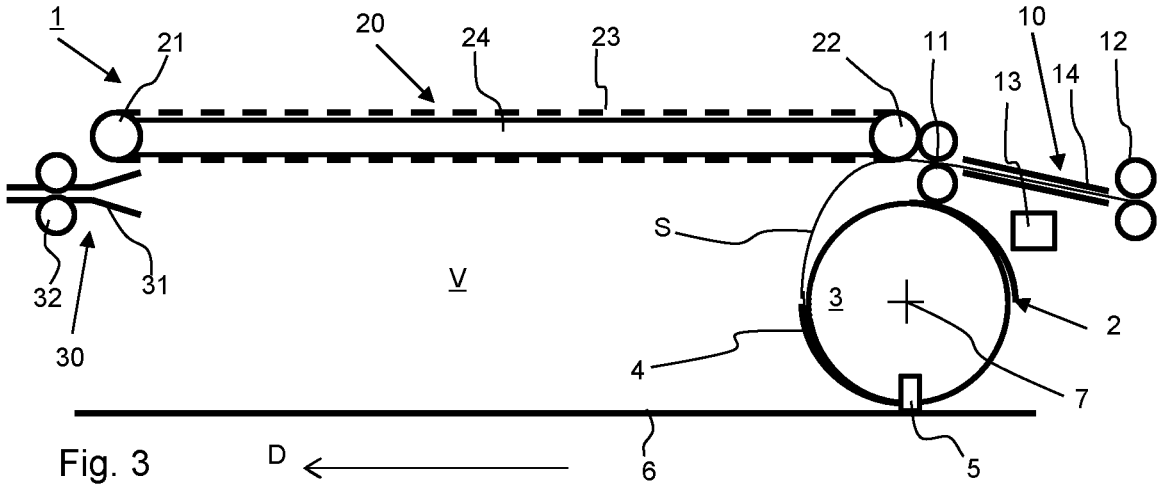
FIG. 3 is a schematic cross-sectional side view of the sheet stacker of FIG. 1 in the second state wherein a portion of the sheet is drawn against the holding device.
Figure 4:
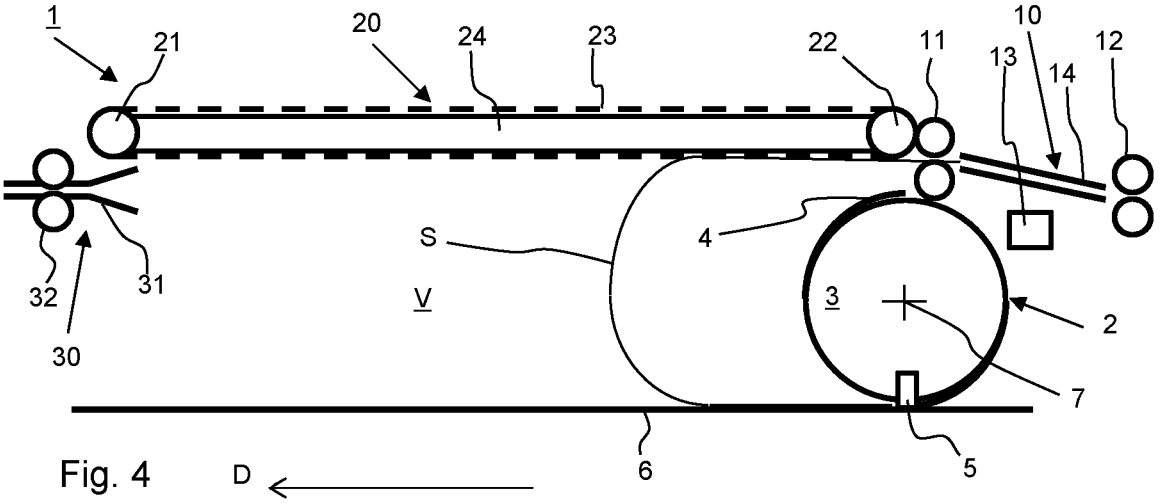
FIG. 4 is a schematic cross-sectional side view of the sheet stacker of FIG. 1 wherein the sheet is flipped while a portion of it is held and transported by the holding device.

FIG. 4 illustrates the step of the holding device 20 engaging a portion of the sheet S. In the embodiment in FIG. 4 the actuator 13 is operated to move the sheet supply path 10 from its first position as illustrated in FIGS. 1 and 2 to the second position shown in FIG. 3. The actuator 13 may be formed by a motor, coil actuator, pneumatic actuator, etc. The controller controls the activator 13 upon detecting that the flipping wheel 3 has reached its trigger position, which in this example corresponds to the eject position, wherein the leading edge of the sheets first contacts the stop element 5. The actuator 13 shifts or tilts the sheet supply path 10, such that its downstream end extends towards the holding device 10. A portion of the sheet S is thereby brought sufficiently close to the holding device 20, such that the holding device is able to draw and hold a portion of the sheet S against it. During this operation the rotation of the flipping wheel 3 may be stopped or the flipping wheel 2 may continue to rotate at a suitable speed, for example to timely position a slot 4 at the receiving position for the arrival of a subsequent sheet S.

It will be appreciated that the sheet S may in another embodiment be brought into contact with the holding device 20 by an outward folding motion of the sheet S, which is achieved by setting circumferential velocity of the flipping wheel lower than the transport sheet of the transport device 11, 12 on the sheet supply path 10. The transport device 11, 12 and guide element 14 may be suitably configured and positioned to allow for the outward radial motion of the sheet S.

The holding device 20 in FIG. 3 is embodied as a conveyor 20. The conveyor comprises an endless belt 23 suspended on rollers 21, 22. A drive or motor (not shown) is provided for driving the rollers 21, 22, and thereby the belt 23. The belt 23 is perforated, such that it comprises a plurality of suction holes, through which air may be drawn into the suction box 24. The suction box 24 comprises or is connected to a suction device (not shown), such as a pump or fan. The surface of the suction box 24 facing the flipping volume V is provided with one or more opening to allow air to be drawn in via suction holes in the belt 23. In this manner an underpressure may be applied to a portion of the sheet S, such that the sheet S is held against the belt 23. The holding surface corresponds to the area through underpressure may be applied through the belt 23. The holding surface preferably extends parallel to the stacking surface 6, which defines the first direction D. It will be appreciated that other suitable holding devices, such as electrostatic sheet holding devices, rollers, or side edge grippers may be applied with the present invention.

FIG. 4 shows the continued flipping motion of the sheet S. While the leading edge of the sheet S is at a standstill at the stop element 5, the trailing portion of the sheet S is fed from the sheet supply path 10 towards the holding device 20. The holding device 20 holds and transports the trailing portion of the sheet S away from the sheet supply path 10 in the first direction D parallel to the stacking surface 6 of the sheet flipping device 2.

Figure 5:
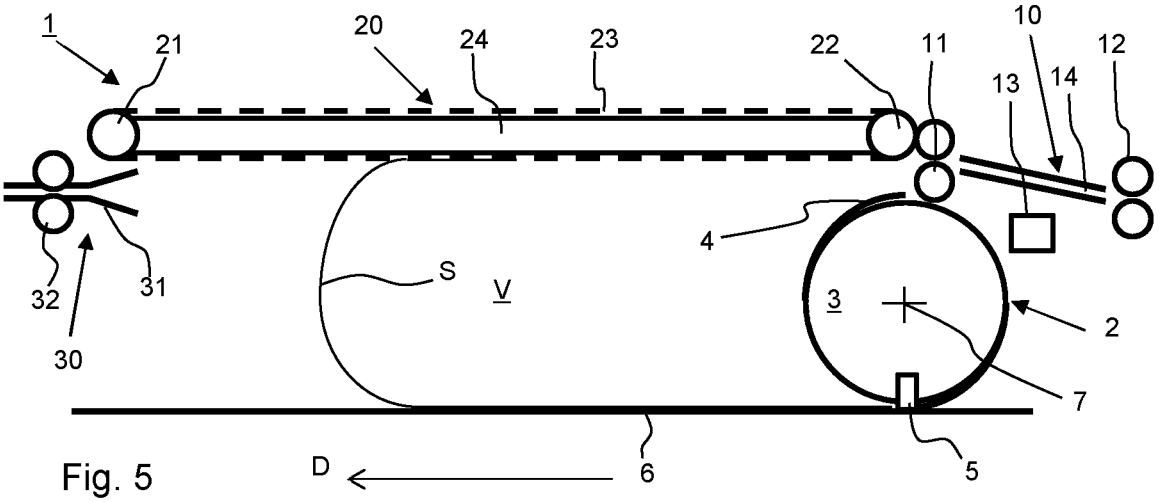
FIG. 5 is a schematic cross-sectional side view of the sheet stacker of FIG. 1 wherein the sheet is further flipped while a portion of it is held and transported by the holding device.

FIG. 5 illustrates the trailing portion of the sheet S having left the sheet supply path 10. The flipping wheel 3 may herein be re-positioned in the receiving position for receiving a subsequent sheet. The trailing portion continues to be held by the holding device 20 as it moves parallel to the stacking surface 6. The trailing portion of the sheet S may be gradually released from the holding device 20, as it moves away from the sheet supply path 10. Thereto, the suction box 24 may be divided into a plurality of chambers, each of which may be individually provided with an underpressure independent of the other chambers. In another example, the suction box 24 may have a predetermined length in the first direction D, such that beyond said length no underpressure is applied. The sheet is locally released when reaching the end point of said length of the suction box 24.

Figure 6:
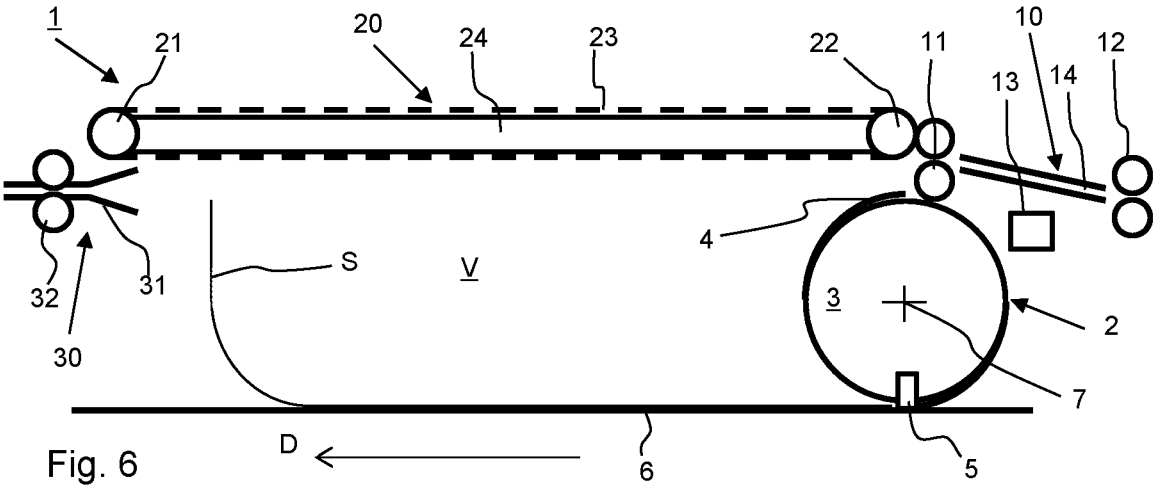
FIG. 6 is a schematic cross-sectional side view of the sheet stacker of FIG. 1 wherein the sheet is released from the holding device.

FIG. 6 illustrates the holding device 20 releasing the trailing portion of the sheet S at the downstream portion of the stacking surface 6. As indicated above, the underpressure may be removed from the suction box, either in its entirety, after a predetermined end point, or via individual chambers. The flipped sheet S is shown in FIG. 7, where it rests upon the stacking surface 6 (or on a stack of previously flipped sheets). The actuator 13 returns the sheet supply path 10 to its first position for receiving a subsequent sheet. The actuator may return the sheet supply path 10 at any suitable moment, preferably after the trailing portion of the sheet S has exited the sheet supply path 10.

Since in FIGS. 3 to 5 the trailing portion of the sheet S is held against the holding device 20, the sheet S is prevented from collapsing upon itself. This results in a reliable sheet stacker 1. The holding device 20 allows the sheet stacker 1 to handle a wider range of print media sheets, particularly longer and/or more flexible sheets, such as low grammage paper or thin foils of other materials, such plastics.

FIG. 8 illustrates the holding device 20 transporting a sheet S from the sheet supply path 10 to a bypass path 30. The actuator 13 is controlled to position the sheet supply path 10 in the second position, such that the leading portion, and subsequently the rest of the sheet S, is drawn against the holding device 20. The sheet S thereby bypasses the sheet flipping device 2. The bypass path preferably comprises a receiving guide 31 for receiving the trailing portion of the sheet from the holding device 20. A transport device 32 is provided on the bypass path 30 to bring the sheet S towards its intended output destination, for example a finisher device, for further processing of the sheet S. The sheet S may also be output to an output tray, where the sheets S may be stacked with flipping. Sheets S with dimensions exceeding the capacity of the sheet flipping device 2 may thereby still be output by the printer to the sheet stacker 1, removing the need for a separate, external bypass path.

Figure 9:
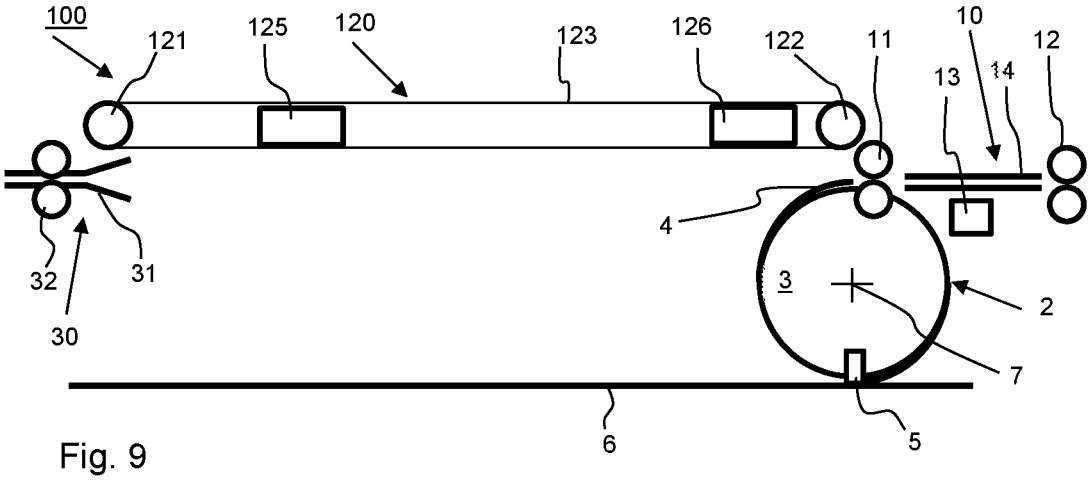
FIG. 9 is a schematic cross-sectional side view of another embodiment of the sheet stacker according to the present invention.

FIG. 9 illustrates an embodiment of the sheet stacker 100, wherein the holding device 120 comprises an electrostatically chargeable belt 123. The sheets S may be adhered to the belt 123 by applying an appropriate charge. A charge applicator 126 is provided for charging at least a portion of the belt 123. A further charge applicator 125 or remover 125 may be positioned along the belt 123 to affect release of the sheet S at the desired position.

Figure 10:
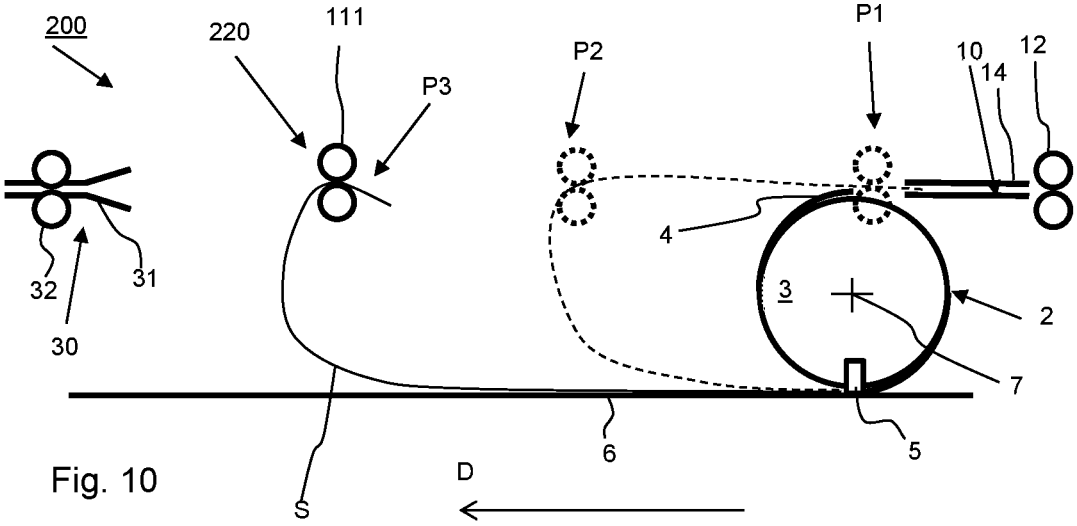
FIG. 10 is a schematic cross-sectional side view of a further embodiment of the sheet stacker according to the present invention.

FIG. 10 illustrates a further embodiment of the sheet stacker 200, wherein the holding device 220 in a first position P1 forms the transport device 111 of the sheet supply path 10. After the trigger position is reached, the transport device 111 is moved in the first direction D, for example by a conveyor or a moveable arm towards the second position P2, while still engaging the trailing portion of the sheet S. The transport device 111 is further moved to the third position P3, after which it releases the trailing edge of the sheet S. The transport device 111 may for example be a regular pinch or a drivable transport pinch.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet stacker comprising :

A sheet flipping device for flipping a received sheet around a flipping axis with respect to an orientation wherein the sheet was received;

A holding device for releasably holding at least a portion of the sheet at least partially during the flipping of the sheet by the sheet flipping device, wherein the holding device is configured for movement of the held portion of the sheet in a first direction perpendicular to the flipping axis; and a sheet supply path for supplying sheet to the sheet flipping device, wherein sheet supply path and the holding device are moveable with respect to one another between a first position wherein a portion of the sheet may pass into the sheet flipping device without being adhered against the holding device and a second position wherein the holding device is able to draw a portion of the sheet against it.

2. The sheet stacker according to claim 1, wherein in the second position the distance between the holding device and the sheet supply path is smaller than in the first position.

3. The sheet stacker according to claim 1, wherein the sheet supply path is moveable with respect to both the holding device and the sheet flipping device.

4. The sheet stacker according to claim 1, wherein the sheet flipping device comprises a flipping wheel provided with at least one slot for receiving the sheet.

5. The sheet stacker according to claim 1, wherein the holding device comprises a holding surface to which the portion of the sheet is adhered during flipping, the holding surface being moveable in the first direction.

6. The sheet stacker according to claim 5, wherein the holding device comprises an endless conveyor belt.

7. The sheet stacker according to claim 6, wherein the conveyor belt is provided with suction holes for applying an underpressure to the portion of the sheet, such that the portion is held against the belt.

8. The sheet stacker according to claim 6, wherein the flipping device defines a flipping volume through which the sheet travels during flipping, and wherein conveyor belt is positioned over the flipping device and over the flipping volume.

9. The sheet stacker according to claim 1, wherein the holding device is positioned over the sheet flipping device and extends away from the sheet flipping device in the first direction parallel to a sheet stacking surface for receiving the flipped sheets.

10. The sheet stacker according to claim 1, further comprising a controller configured to control the sheet stacker, such that:

in a first state a leading portion of the sheet is received by the sheet flipping device and partially transported by the sheet flipping device without the leading portion being drawn against the holding device;

in a second state a trailing portion of the sheet is drawn against the holding device during the flipping motion of the sheet.

11. The sheet stacker according to claim 4, wherein the flipping wheel has a receiving position for receiving a sheet from a sheet supply path and a trigger position different from the receiving position, wherein the controller is configured to switch from the first to the second state when the flipping wheel reaches the trigger position.

12. The sheet stacker according to claim 11, wherein a stop element is positioned along the flipping wheel for ejecting a sheet from its slot, wherein the stop element defines the trigger position.

13. The sheet stacker according to claim 1, wherein the holding device extends between a sheet supply path and a bypass path such that the sheet may be transported from the sheet supply path to the bypass path without engagement with the sheet flipping device.

14. A sheet printer comprising a sheet stacker according to claim 1.

15. A method for stacking sheets comprising the steps of:

A sheet flipping device flipping a sheet;

A holding device engaging a portion of the sheet and said holding device transporting the held portion away from a flipping axis of the sheet flipping device;

The holding device releasing the portion of the sheet during the final part of the flipping motion of the sheet;

Moving a sheet supply path with respect to the holding device for supplying sheet to the sheet flipping device between a first position wherein a portion of the sheet may pass into the sheet flipping device without being adhered against the holding device and a second position wherein the holding device is able to draw a portion of the sheet against it.

16. The method according to claim 15, further comprising the steps of:

Moving the sheet supply path with respect to the holding device into the first position; and While in the first position, passing a portion of the sheet may from the sheet supply path into the sheet flipping device without being adhered against the holding device.

17. The method according to claim 16, further comprising the steps of:

Moving the sheet supply path with respect to the holding device into the second position; and While in the second position, the holding device drawing a portion of the sheet against it.

* * * * *